US006292985B1

(12) United States Patent
Grunberger

(10) Patent No.: US 6,292,985 B1
(45) Date of Patent: Sep. 25, 2001

(54) MAGNETIC CLOSURE WITH MUTUAL INTERLOCK FOR BAGS, KNAPSACKS, ITEMS OF CLOTHING AND THE LIKE

(75) Inventor: Erico Grunberger, Milan (IT)

(73) Assignee: SAMA S.p.A., Ronco Briantino (IT)

( * ) Notice: Subject to any disclaimer, the term of this patent is extended or adjusted under 35 U.S.C. 154(b) by 0 days.

(21) Appl. No.: 09/212,427

(22) Filed: Dec. 16, 1998

(30) Foreign Application Priority Data

Dec. 22, 1997 (IT) ..... MI97A2846

(51) Int. Cl.[7] ..... A44C 5/00; A44B 21/00

(52) U.S. Cl. ..... 24/303; 24/588; 24/616

(58) Field of Search ..... 24/303, 298, 16 PB, 24/307, 326, 66.1, 588, 616; 2/312, 322; 335/285; 63/3.1, 3

(56) References Cited

U.S. PATENT DOCUMENTS

| | | | | |
|---|---|---|---|---|
| 2,615,227 | * | 10/1952 | Hornik | 24/303 |
| 3,376,616 | | 4/1968 | Kaczorowski . | |
| 3,589,341 | * | 6/1971 | Krebs | 24/303 X |
| 4,121,324 | * | 10/1978 | Marbacher | 24/303 |
| 4,231,137 | * | 11/1980 | Fujimoto | 24/303 |
| 5,008,984 | * | 4/1991 | Levy | 24/303 |
| 5,311,647 | * | 5/1994 | Levy | 24/303 |
| 5,349,725 | * | 9/1994 | Levy | 24/303 |
| 5,367,891 | * | 11/1994 | Furuyama | 24/303 X |
| 5,572,887 | * | 11/1996 | Geswelli | 24/303 X |
| 5,664,298 | * | 9/1997 | Nessar-Ivanovic | 24/303 |

FOREIGN PATENT DOCUMENTS

| | | |
|---|---|---|
| 37 36 254 | 5/1989 | (DE) . |
| 74 871 | 6/1961 | (FR) . |
| 1 465 402 | 3/1967 | (FR) . |
| 2 063 284 | 7/1971 | (FR) . |
| 2 484 223 | 12/1981 | (FR) . |
| 2 612 378 | 9/1988 | (FR) . |

* cited by examiner

*Primary Examiner*—Robert J. Sandy
(74) *Attorney, Agent, or Firm*—Guido Modiano; Albert Josif; Daniel O'Byrne

(57) ABSTRACT

A magnetic closure with mutual interlock for bags, knapsacks, items of clothing and the like, comprising a female element and a male element with regions for accommodating magnetic elements for mutual coupling. A particularity consists in that there are provided, on the female element, guiding means for coupling to the male element and, on the male element, mechanical engagement elements which are adapted to contrast the mutual sliding of the male element and the female element.

10 Claims, 5 Drawing Sheets

1
2
4
10
11
12
13
15
16
20
21
22
23
30

MAGNETIC CLOSURE WITH MUTUAL INTERLOCK FOR BAGS, KNAPSACKS, ITEMS OF CLOTHING AND THE LIKE

BACKGROUND OF THE INVENTION

The present invention relates to a magnetic closure with mutual interlock for bags, knapsacks, items of clothing and the like.

It is known that snap-acting closures which are already commercially available are used for example in bags, knapsacks and the like and utilize, both for closing and for opening, the elasticity of the materials that constitute arms of the male element that enters, with a snap action, a corresponding female seat.

Other mechanical solutions provide for a spring-loaded operation for the mutual coupling of the two parts.

Magnetic closures are also known which are normally used to close bags and are substantially constituted by magnetic elements which couple by means of their mutual magnetic attraction; however, said magnetic closure devices have had a relatively limited use due to the fact that they do not allow optimum resistance to forces acting at right angles to the direction of the magnetic flux because the two components are slideable with respect to each other.

SUMMARY OF THE INVENTION

The aim of the present invention is to solve the above-described problems by providing a magnetic closure with mutual interlock for bags, knapsacks, items of clothing and the like which though using the principle of magnetic coupling is capable of ensuring considerable resistance even to forces acting at right angles to the directions of the magnetic flux.

Within the scope of this aim, a particular object of the invention is to provide a magnetic closure which, though allowing quick and stable coupling, can also be opened easily by performing a simple sequence of movements.

Another object of the present invention is to provide a magnetic closure which, thanks to its particular constructive characteristics, is capable of giving the greatest assurances of reliability and safety in use.

Another object of the present invention is to provide a magnetic closure with mutual interlock which can be easily obtained starting from commonly commercially available elements and materials and is also competitive from a merely economic point of view.

This aim, these objects and others which will become apparent hereinafter are achieved by a magnetic closure with mutual interlock for bags, knapsacks, items of clothing and the like, according to the invention, which comprises a female element and a male element with regions for accommodating magnetic means for mutual coupling, characterized in that it comprises, on said female element, guiding means for coupling to said male element and, on said male element, mechanical engagement means which are adapted to contrast the mutual sliding of said male element and said female element.

BRIEF DESCRIPTION OF THE DRAWINGS

Further characteristics and advantages of the present invention will become apparent from the following detailed description of a preferred but not exclusive embodiment of a magnetic closure with mutual interlock for bags, knapsacks, items of clothing and the like, illustrated by way of non-limitative example in the accompanying drawings, wherein.

DESCRIPTION OF THE PREFERRED EMBODIMENTS

Figure 1:
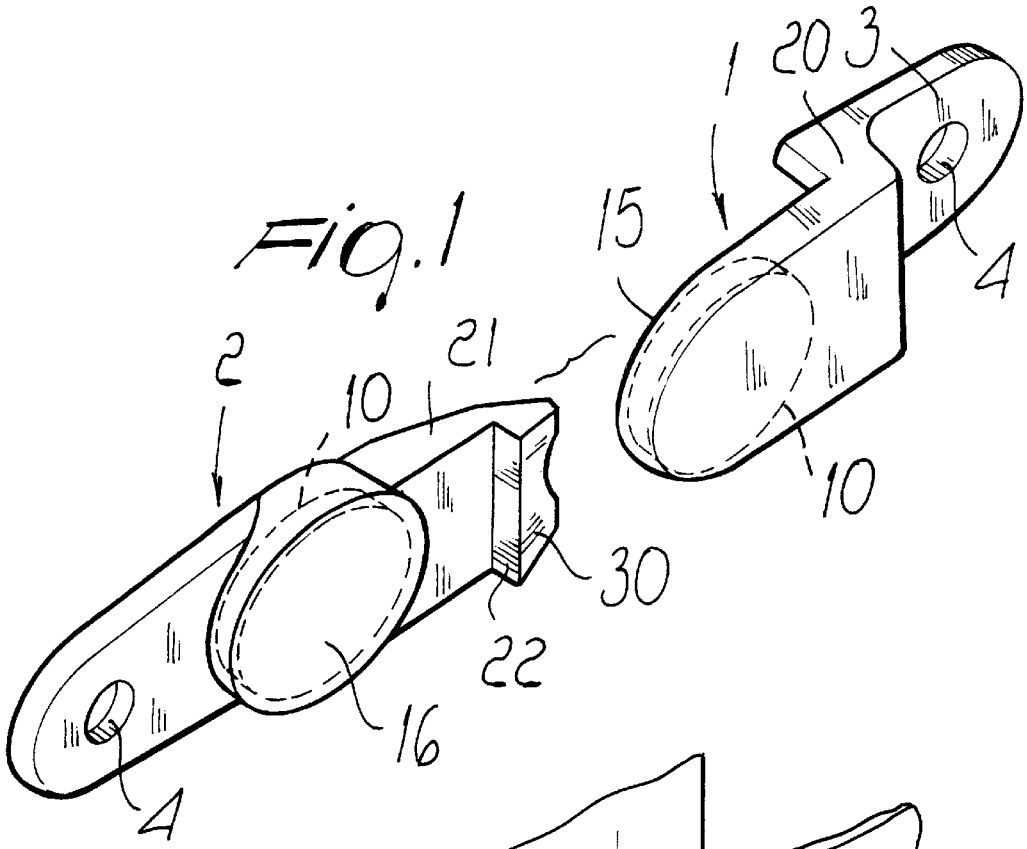
FIG. 1 is a schematic perspective view of the magnetic closure according to the invention in the open position.
Figure 2:
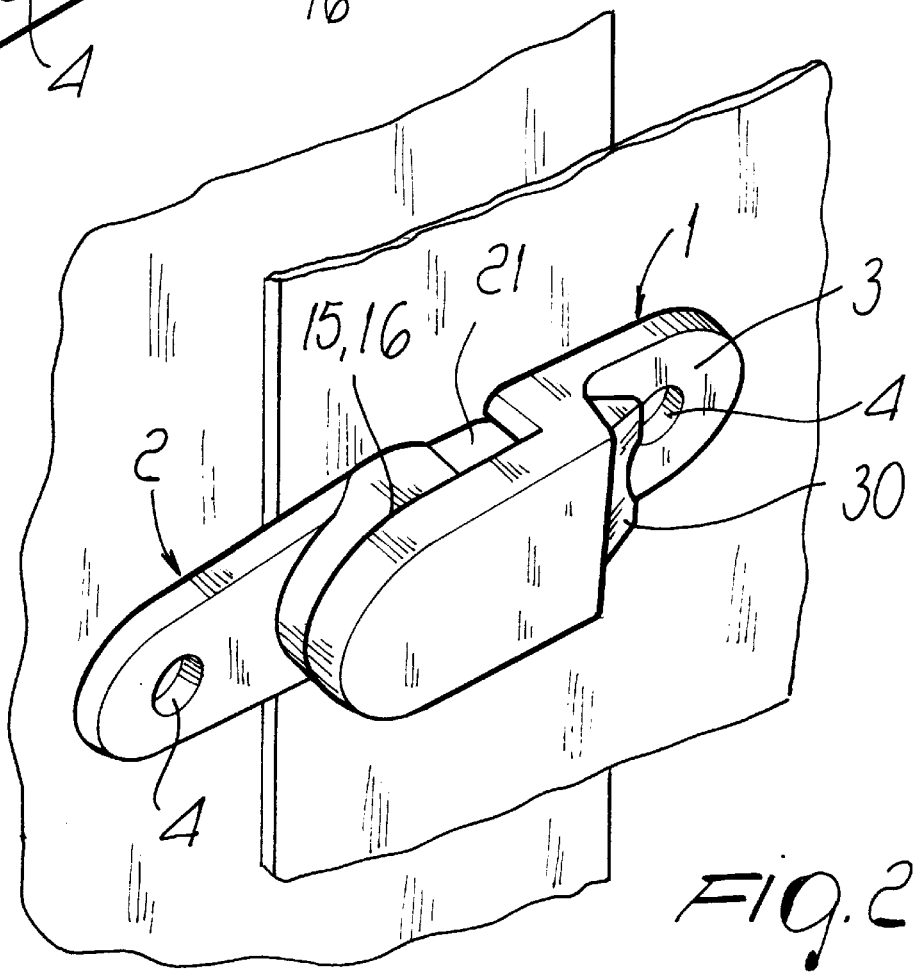
FIG. 2 is a schematic perspective view of the magnetic closure in the closed position.

With reference to the above figures, the magnetic closure with mutual interlock for bags, knapsacks, items of clothing and the like, according to the invention, comprises a female element 1 and a male element 2 which can assume different configurations and are provided with means for connection to the elements or flaps to be joined which can be shaped in any manner according to the type of connection used.

In the specific example, for the male element and for the female element there is provided a tab 3 having a hole 4 for applying the elements to the flaps by riveting; clearly, as mentioned, other systems for coupling to the flaps to be joined are possible.

The female element and the male element internally form regions 10 for accommodating magnetic means which produce the mutual coupling of the male element and of the female element.

For example, it is possible to provide, in said regions 10, a toroidal permanent magnet 11 which is supported by a plate 12 made of ferromagnetic material with a ferromagnetic core 13 which is arranged axially.

Advantageously, the magnetic body is constituted by a permanent magnet which is associated with the ferromagnetic plate meant to concentrate the lines of magnetic flux, thus allowing to obtain a magnetic closure in which the flux lines are substantially directed outward and have no significant emissions at the rear of the item, which might be in continuous contact with the body of the user.

Of course, the type of magnetic means can be changed in any manner and it is possible to provide, on one of the elements, a ferromagnetic element rather than having to necessarily provide an element constituted by a permanent magnet.

The regions 10 are closed by coupling surfaces 15 for the female element and 16 for the male element, which can be made of plastics or nonferromagnetic metallic material which provides the surface for the mutual coupling and contact of the male element and the female element.

A first characteristic of the invention consists in that the female element 1 forms guiding means for the insertion of the male element which are constituted by mutually spaced side walls 20 which are interposed between the part where there is the region 10 with the fi corresponding magnetic element and the region for connection to the flap to be joined.

A protrusion 21, formed on the free end of the male element, i.e., on the opposite end with respect to the end for connection to the flap to be joined, can be inserted between said side walls 20.

Said protrusion 21 advantageously has a V-shaped configuration so as to facilitate insertion between the side walls, but most importantly it has mechanical engagement means which are constituted by a tooth 22 which couples mechanically with an abutment 23 formed by the female element, so as to constitute an element which contrasts the mutual sliding of the male element and of the female element and constitute in particular an element which provides retention in the direction of separation, along a path which is substantially perpendicular to the direction of the lines of flux.

Figures 3, 4, 5:
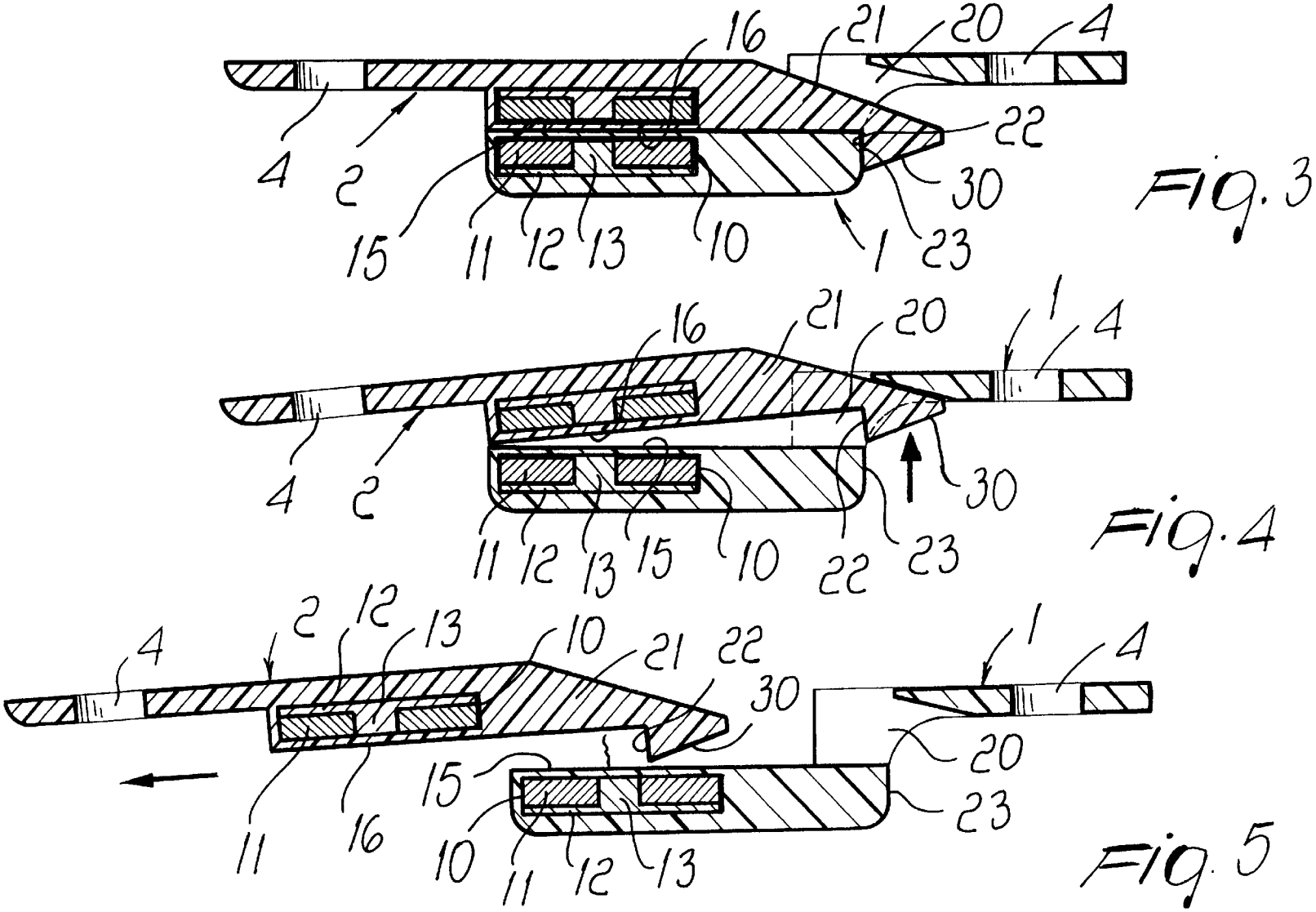
FIG. 3 is a sectional view of the magnetic closure in the closed position.
FIG. 4 is a view of the initial step for opening, with disengagement of the mechanical engagement means.
FIG. 5 is a view of the closure in the open position.

At the engagement tooth 22, the male element forms a projection 30 which can be pressed with a finger so as to mutually space the regions where the magnetic means are provided; in practice said pressing action is converted into an oscillation of the male element with respect to the female element, as shown in FIG. 4, hence facilitating the following step for separation by mutual spacing.

Figure 6:
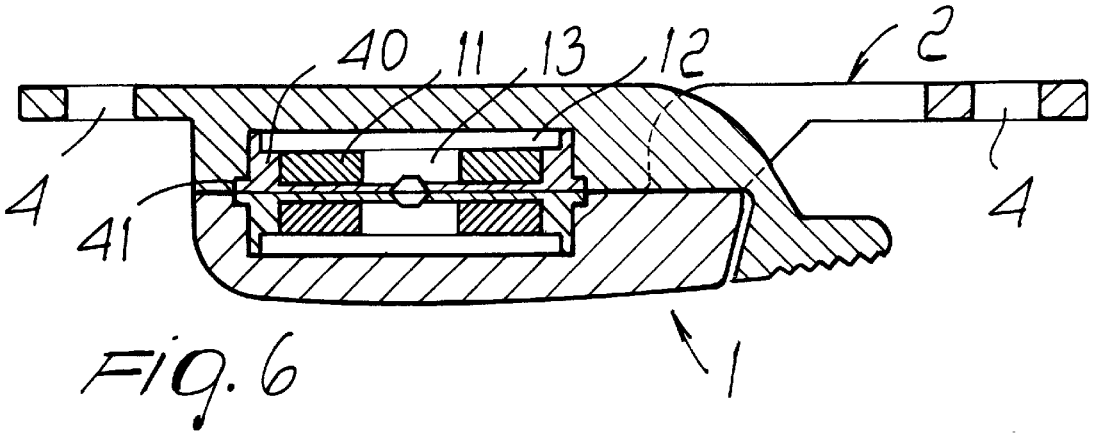
FIG. 6 is a sectional view of the closure with a different application configuration of the magnetic means.
Figure 7:
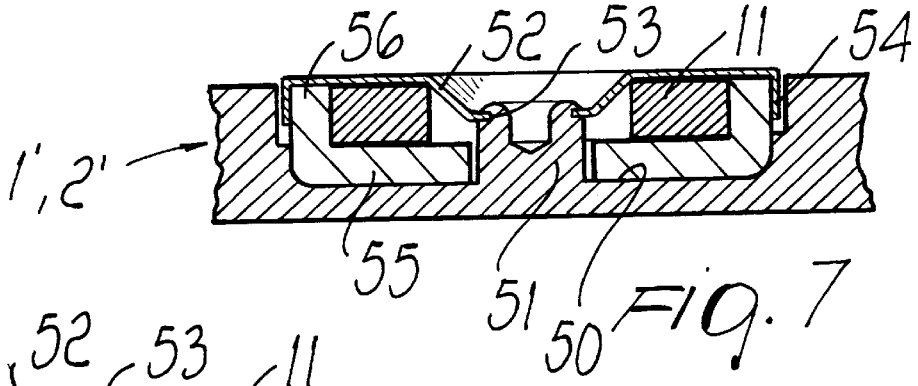
FIG. 7 is a longitudinal sectional view of a closure made of nonmagnetic metallic material.
Figure 8:
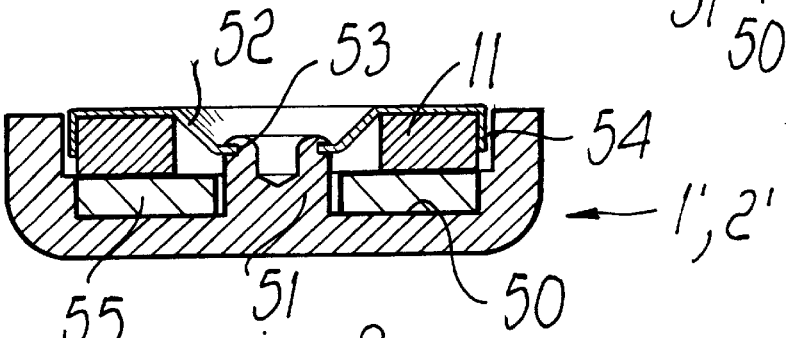
FIG. 8 is a transverse sectional view of a closure made of nonmagnetic metallic material.
Figure 9:
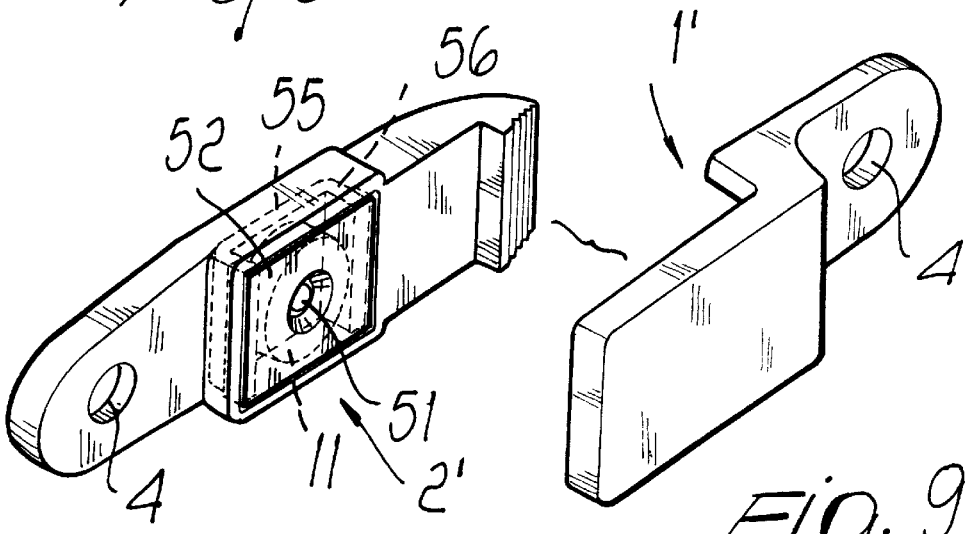
FIG. 9 is a perspective view of a closure made of nonmagnetic metallic material.

As shown in FIG. 6, the magnetic elements can be provided separately and subsequently applied to the body of the closure. In particular, it is possible to provide a container 40 with a flange 41 inside which there is the toroidal magnet 11, which is supported by the plate 12 with a ferromagnetic core 13; the container is connected in a seat provided for this purpose in the body in which it is to be coupled, and the closure can be obtained by welding or with any other solution capable of ensuring tightness.

If the female element 1' and the male element 2' are made of nonmagnetic metallic material, such as for example an alloy of zinc, aluminum and magnesium, it is possible to provide, at the face where mutual coupling occurs, a recess 50 provided with a central protrusion 51 which is riveted to a dome 52 with a central hole 53 made of nonferromagnetic material.

The dome is shaped so as to have a lateral border 54 which laterally covers the toroidal magnetic element, again designated by the reference numeral 11.

Advantageously, the toroidal magnetic element is supported by a U-shaped bracket 55 which is arranged on the bottom of the recess 50 and has arms 56 which are directed towards the dome 52, so as to convey the lines of the magnetic field in order to produce stronger attraction of the two, male and female, parts of the closure.

Figure 10:
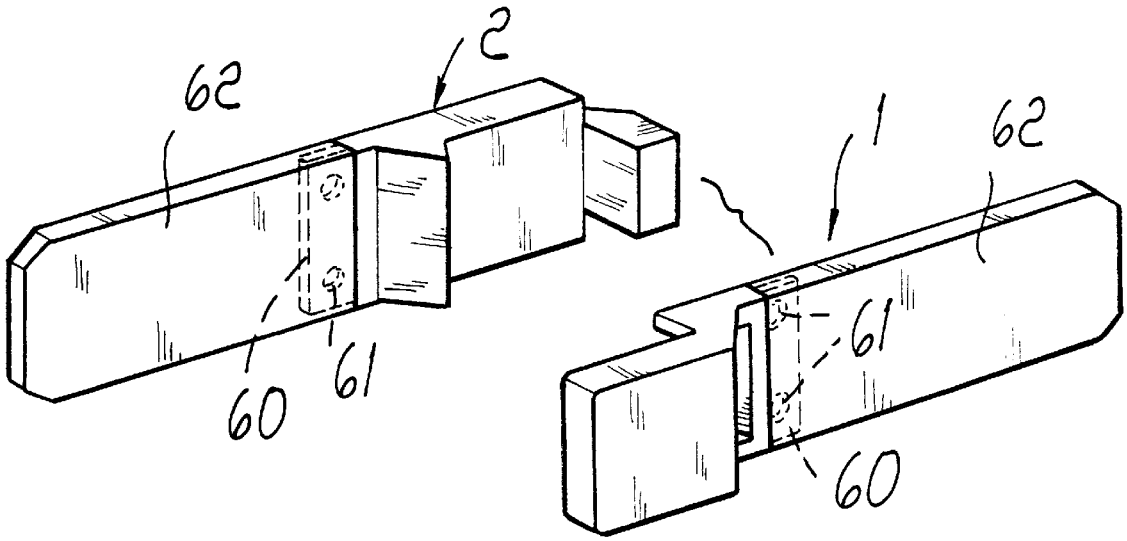
FIG. 10 is a perspective view of a closure to which a strap for connection by stitching has been applied.
Figure 13:
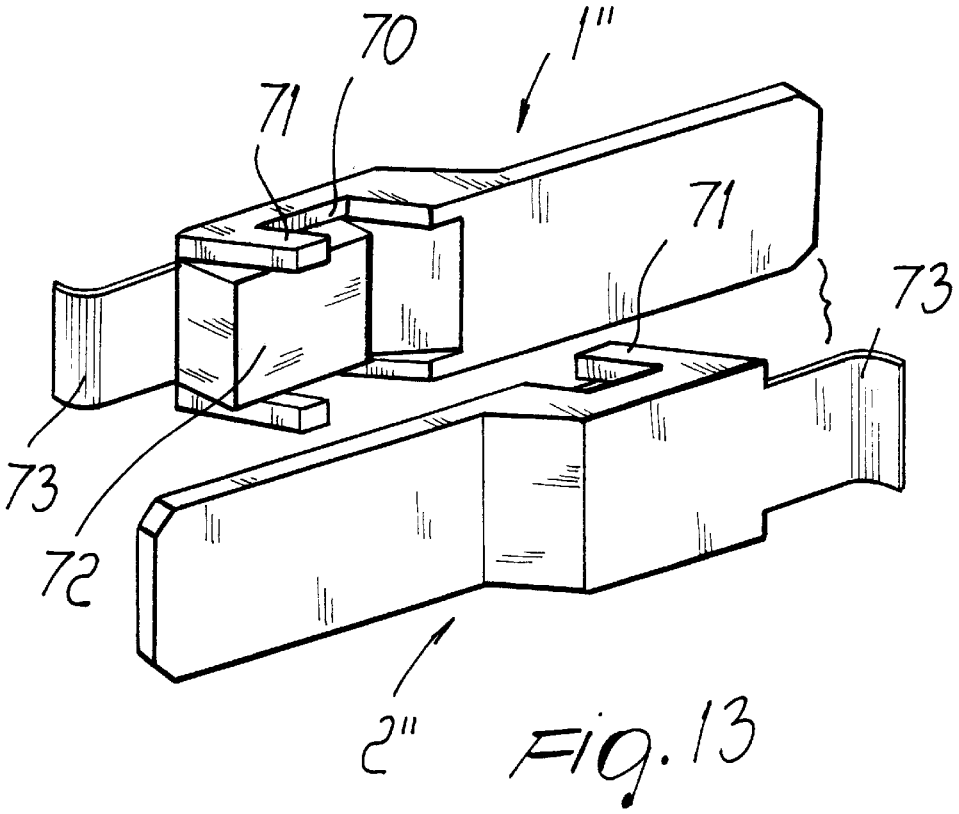
FIG. 13 is a perspective view of a closure formed with mechanically symmetrical elements.
Figure 11:
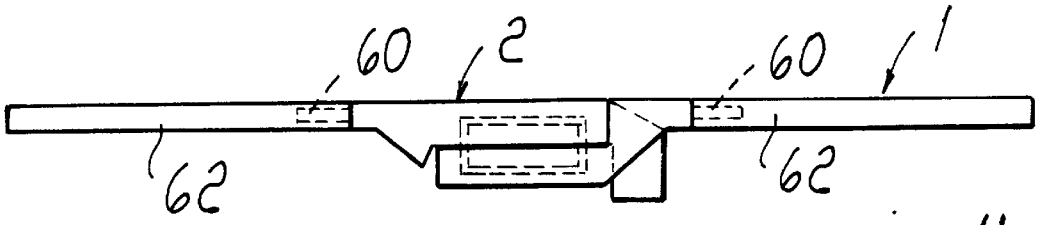
FIG. 11 is a schematic top plan view of the closure of FIG. 10.
Figure 12:
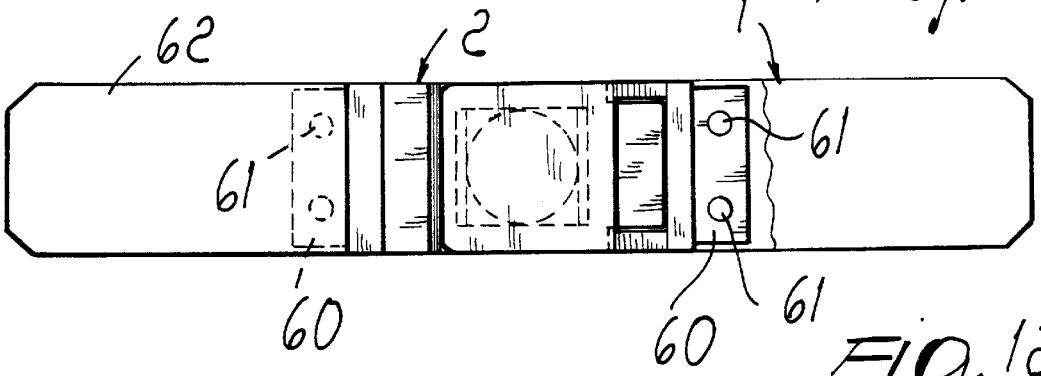
FIG. 12 is a partially cutout front view of the closure of FIG. 10.
Figure 14:
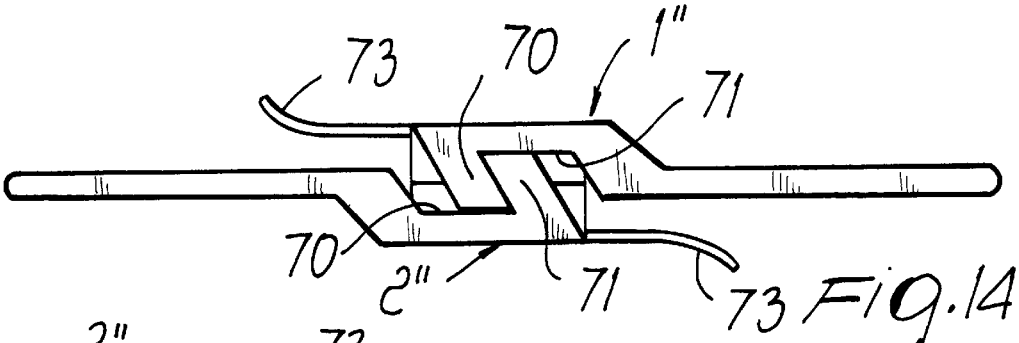
FIG. 14 is a top plan view of the closure of FIG. 13.
Figure 15:
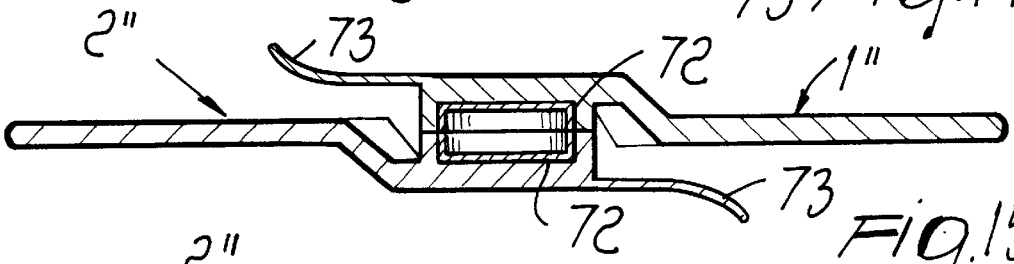
FIG. 15 is a sectional view of the closure of FIG. 13.
Figure 16:
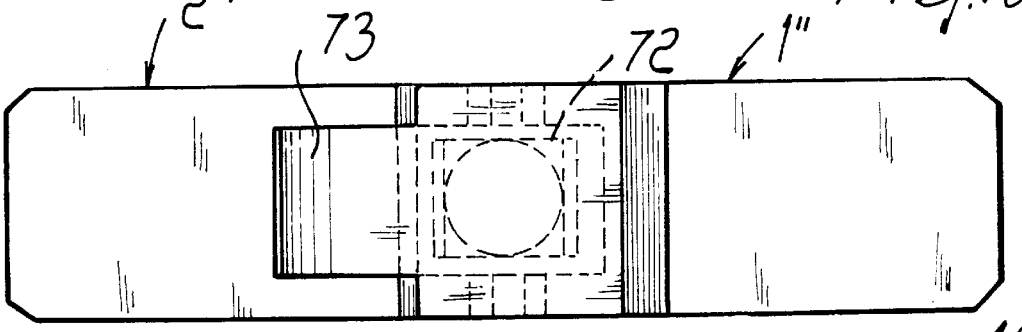
FIG. 16 is a front view of the closure of FIG. 13.

As shown in FIG. 10, when the female element 1' and the male element 2' are made of nonmagnetic material, it is possible to provide, for connection to an item of clothing or the like, a plastic strap which allows application by sewing instead of the usual riveting.

In this case there is a tang 60 which is connected to each one of the elements and is provided with through holes 61. A plastic strap or the like 62 is applied to the tang 60 by overmolding and constitutes the region for forming stitches for connection to the item of clothing or the like to which the closure is to be applied.

With reference to FIGS. 13 to 16, an embodiment is shown in which the male element 1" and the female element 2" are mechanically identical one another and in particular there are identical guiding means both for the female element and for the male element, which are constituted by recesses 70 formed on the sides of the male and female elements, now designated by the reference numerals 1" and 2"; said recesses are delimited by mechanical engagement means which are constituted by a pawl-like tooth 71 which is laterally adjacent to the recesses 70 and is structured so as to fit in the recess 70 of the opposite element.

In this manner, a symmetrical coupling is provided with the magnetic elements having opposite polarities or with a magnetic element and a ferromagnetic element arranged in the central portion 72 of the elements 1" and 2".

Grip tabs 73 are furthermore provided which protrude from the central body and allow to produce mutual disengagement.

Clearly, the type of magnetic element used can be changed in any manner according to the requirements; likewise, the means for fixing to the item of clothing and the like may be any: fixing can in fact be performed by stitching, welding, riveting, with a tape, with staples or with other per se known methods.

From the above description it is thus evident that the invention achieves the intended aim and objects and in particular it is stressed that a magnetic closure of the interlock type is provided in which the magnetic coupling of the male element to the female element is combined with a mechanical coupling which acts as a retainer which prevents mutual sliding but can be easily removed simply by pressing on the projection provided on the side of the tooth, so as to cause by rotation the mutual spacing of the magnetic means of the male element and the magnetic means of the female element, thus making it easy to perform the subsequent separation, also thanks the fact that the tooth no longer engages the corresponding abutment of the female element.

Moreover, particular attention is drawn to the fact that the magnetic closure is constructively very simple and quite easy to use and that the resulting coupling is highly stable.

The invention thus conceived is susceptible of numerous modifications and variations, all of which are within the scope of the inventive concept.

All the details may also be replaced with other technically equivalent elements.

In practice, the materials employed, as well as the contingent shapes and dimensions, may be any according to the requirements.

What is claimed is:

1. A magnetic closure with mutual interlock for knapsack, luggage and clothing items, comprising: a female element; a male element; said female and male elements being adapted for connection to flaps of said items; magnetic means for mutual coupling of said female and male elements; accommodation regions provided at said female and, respectively, male elements for accommodating said magnetic means; guiding means provided at said female element for guidingly receiving said male element; and mechanical engagement means for providing mutual engagement between said female and male elements so as to contrast sliding movement of said male element with respect to said female element and wherein said accomodation regions comprise coupling surfaces made of nonferromagnetic material, said coupling surfaces being located so as to close said accomodation regions and provide contact regions between said female and male element, said guiding means of the female element being adopted to allow engagement/disengagement of the male element with respect to the female element along a direction which is substantially perpendicular to a line orthogonal to the coupling surfaces of said male and female elements.

2. A magnetic closure with mutual interlock for knapsack, luggage and clothing items, comprising: a female element; a male element; said female and male elements being adapted for connection to flaps of said items; magnetic means for mutual coupling of said female and male elements; accommodation regions provided at said female and, respectively, male elements for accommodating said magnetic means; guiding means, provided at each one of said female and male elements, for guiding the mutual coupling of said elements; and mechanical engagement means for providing mutual engagement between said female and male elements so as to contrast sliding movement of said male element with respect to said female element, and wherein said guiding means are constituted by mutually spaced side walls which are formed at said female element and are laterally adjacent to the accomodation region thereof; and wherein a protrusion is provided which is formed on a free end of said male element, said protrusion being insertable between said side walls, and wherein said protrusion has a V-shaped configuration which facilitates insertion between said side walls, said mechanical engagement means being constituted by a tooth which is formed by said protrusion, and by an abutment formed by said female element, said protrusion being locatable, upon closing of the closure, in engaging relationship with said abutment.

3. The magnetic closure of claim 2, wherein said magnetic means generate a magnetic flex having a flux direction thereof, and said tooth constitutes a retention element for preventing separation of said female and male elements, along a path which lies substantially at right angles to the direction of the magnetic flux.

4. The magnetic closure of claim 3, comprising on said protrusion a projection, said projection forming a push up region to be pushed in order to mutually space the accomodation regions of said male and female elements.

5. The magnetic closure of claim 2, comprising a container provided with a flange, said container intentionally accomodating said magnetic means and being hermetically coupleable to said male and female elements.

6. The magnetic closure of claim 2, wherein said female element and said male element are made of nonmagnetic metallic material, and said regions for accomodating said magnetic means comprise a recess provided with an axial protrusion; a dome made of nonferromagnetic material for retaining said magnetic means, a central hole located at said dome, with said protrusion being coupleable by riveting into said central hole.

7. The magnetic closure of claim 6, wherein said magnetic mean are torodial, the closure further comprising: a U-shaped bracket made of ferromagnetic material which internally supports said magnetic means and engages a bottom part of said recess, said bracket having a hole for passage of said protrusion and including arms thereof with free ends being arranged toward said dome.

8. The magnetic closure of claim 6, comprising plastic straps forming sewing regions for said female and male elements, and tangs, provided at each one of said female and male elements, and having through openings enabling overmolding of a respective said plastic strap.

9. The magnetic closure of claim 2, wherein said guiding means are constituted by lateral recesses formed in said male element and respectively in said female element, and wherein said mechanical engagement means are provided at each one of said female and male elements and are constituted by pawl-like teeth each of which is located laterally adjacent to a respective said recess so that each one of said teeth is insertable upon coupling in said recess of the other coupled element.

10. The magnetic closure of claim 9, comprising in a central portion of said female and respectively of said male element, a respective grip tab, said grip tabs being operatable for allowing mutual disengagement of said elements.

* * * * *